US007344417B2

(12) United States Patent
Nakayama et al.

(10) Patent No.: US 7,344,417 B2
(45) Date of Patent: Mar. 18, 2008

(54) DIP CONNECTOR

(75) Inventors: Eishu Nakayama, Osaka (JP); Masato Wada, Hyogo (JP)

(73) Assignee: J.S.T. Mfg. Co., Ltd, Osaka (JP)

( * ) Notice: Subject to any disclaimer, the term of this patent is extended or adjusted under 35 U.S.C. 154(b) by 0 days.

(21) Appl. No.: 11/783,658

(22) Filed: Apr. 11, 2007

(65) Prior Publication Data

US 2007/0243745 A1 Oct. 18, 2007

(30) Foreign Application Priority Data

Apr. 12, 2006 (JP) ..... 2006-110332

(51) Int. Cl.
*H01R 24/00* (2006.01)

(52) U.S. Cl. ..... 439/636; 439/733.1; 439/629; 439/352

(58) Field of Classification Search ..... 439/636, 439/733.1, 629, 352, 357, 358
See application file for complete search history.

(56) References Cited

FOREIGN PATENT DOCUMENTS

JP 07-36369 U 7/1995

JP 2000-208185 A 7/2000

*Primary Examiner*—Tho D. Ta
*Assistant Examiner*—Travis Chambers
(74) *Attorney, Agent, or Firm*—Rader, Fishman & Grauer, PLLC

(57) ABSTRACT

The DIP connector of the present invention comprises a housing being provided with a receiving chamber into which a counterpart member being to be fitted, and a contact being fitted in a storing concaved part being concaved from the receiving chamber. The storing concaved part is bounded by a bottom wall, and a first wall and a second wall on both the ends in a width direction and third walls on both sides in a depth direction, of the housing. The bottom wall is provided with a support wall dividing the storing concaved part into a first concaved part and a second concaved part. The contact comprises a bent part straddling on the support wall and one end, in the width direction, of said bent part being to be fitted, in the first concaved part, an intermediate part extending in the width direction from the bent part and being to be stored in the second concaved part, a spring piece rising from the intermediate part in the height direction, and a lead being provided on the fitted-in part of the bent part or on the intermediate part, penetrating the bottom wall and extending.

10 Claims, 8 Drawing Sheets

DIP CONNECTOR

BACKGROUND OF THE INVENTION

1. Field of the Invention

The present invention belongs to a technical field of DIP connectors wherein leads of contacts are inserted into through holes of a board or the like and soldered.

2. Description of Related Art

Japanese Utility Model Publication (unexamined) Heisei 7-36369 discloses a connector, which comprises a housing and contacts, said housing is provided with a receiving chamber, which is concaved from one end in a width direction and into which a counterpart member is to be fitted, and each of said contact, at one end thereof, penetrates a rear wall of the housing and extends into the receiving chamber to be a contact part, and at the other end thereof, extends along the rear wall of the housing in a height direction to be a lead. This connector is mounted on a board by inserting the leads of the contacts into through holes of the board and soldering them thereto. In such a connector, when the contacts are to be fitted into the housing, the contact parts of the contacts are fitted into the rear wall of the housing from the side opposite to that of the receiving chamber.

SUMMARY OF THE INVENTION

When a counterpart member such as a plug connector, which is fitted in such a connector, is to be withdrawn from the connector, a trouble might happen that the housing and the contacts are separated from each other by a force of withdrawing the counterpart member, because the contacts are soldered onto the board and the counterpart member is fitted in the housing. A possible countermeasure to it is to enhance the connecting strength between the housing and the board by providing the housing with reinforcing tabs and soldering the reinforcing tabs onto the board. This arrangement, however, poses another problem that provision of the reinforcing tabs increases the number of components of the connector, and as the number of soldered parts increases, the costs increase.

The present invention was made in view of such points, and one object thereof is to provide a DIP connector wherein a housing is provided with a receiving chamber, which is concaved from one end in a height direction and into which a counterpart member is to be fitted, and a contact is fitted in the housing through an opening of the receiving chamber to increase the strength of connecting the housing to a board or the like and prevent separation between the housing and the contact even if the housing is subjected to a force of withdrawing the counterpart member.

The DIP connector according to the present invention comprises a housing being provided with a receiving chamber being concaved from one end in a height direction thereof and into which a counterpart member being to be fitted, and a contact being fitted in a storing concaved part being provided in the housing and concaved from the receiving chamber; and said storing concaved part being bounded and formed by a bottom wall being located on a side opposite, in the height direction, to an opening of the receiving chamber in the housing, a first wall being provided on one side in a width direction being perpendicular to the height direction, a second wall being provided on the other side in the width direction, and third walls being provided on both sides in a depth direction being perpendicular to both the height direction and the width direction; said housing being provided with a support wall rising from said bottom wall in the height direction and dividing said storing concaved part into a first concaved part on the first wall side and a second concaved part on the second wall side; and said contact comprising a bent part straddling on said support wall and one end, in the width direction, of said bent part being to be fitted, as a fitted-in part, in the first concaved part, an intermediate part extending in the width direction from the other end in the width direction of the bent part and being to be stored in the second concaved part, a spring piece rising from the intermediate part in the height direction and being provided with a contact point for contacting a contact of the counterpart member at a position being near the top end thereof and facing the bent part, and a lead being provided on the fitted-in part of the bent part or on the intermediate part, penetrating the bottom wall of the housing and extending in the height direction.

This DIP connector is to be mounted on a recipient member having through holes, such as a board. Namely, mounting is done by inserting the lead of the contact of the DIP connector in the through hole of the recipient member and soldering the lead onto the recipient member. When the counterpart member is fitted in the receiving chamber, the contact of the counterpart member will contact the contact point of the contact of the DIP connector and mechanical connection and electrical connection will be made between the DIP connector and the counterpart member. And when the counterpart member is withdrawn from the DIP connector, a force withdrawing the counterpart member will work on the housing. However, as the bent part of the contact straddles on the support wall, and the lead being provided on the fitted-in part of the bent part or on the intermediate part is mounted on the recipient member, the force of withdrawing the counterpart member will be reliably transmitted to the contact via the bent part and the support wall opposing to each other and then transmitted to the recipient member via the lead. Accordingly, separation of the housing and the contact will be prevented. In this case, it is possible to do without providing reinforcing tabs, and in turn, increases in costs due to, for example, increase in the number of components of the DIP connector and increase in the number of soldered parts, can be prevented.

As the spring piece rises in the height direction not from the bent part but the intermediate part, the height of the top end of the spring piece is restrained, and reduction in height of the DIP connector can be realized.

When contacts of which leads are provided on the fitted-in parts of the bent parts and contacts of which leads are provided on the intermediate parts are arranged alternately along the depth direction, the leads will be arranged in a zigzag form. With this arrangement, even if the DIP connector has a narrow pitch, namely, the interval between neighboring leads in the depth direction is small, the space between the leads will be widened in effect.

As described above, in the DIP connector of the present invention, as the bent part of the contact is made to straddle on the support wall of the housing, the strength of connecting the housing to the board is enhanced, and in turn, the DIP connector of the present invention successfully provides a DIP connector that can prevent separation of the housing and the contact even if it is subjected to the force of withdrawing the counterpart member from it. Moreover, increase in costs can be prevented by providing no reinforcing tabs. Furthermore, the height of the top end of the spring piece is restrained, and reduction in the height of the DIP connector can be realized. And a DIP connector of narrow pitch can be realized by arranging the leads in a zigzag form.

The DIP connector of the present invention may be so arranged that the intermediate part of the contact is provided with a protrusion protruding in the height direction and the bottom wall of the housing is provided with a hole into which the protrusion is fitted.

With this arrangement, as the intermediate part is securely supported by the bottom wall because the protrusion is fitted in the hole of the bottom wall, relative movement of the intermediate part and the housing is reliably restrained. Thus, as the root end of the spring piece does not shake, and the contact point changes its position according to the resilient deformation of the spring piece, a contact pressure can be secured. Moreover, as the protrusion is fitted in the hole of the bottom wall, positioning of the intermediate part and in turn the spring piece in relation to the housing is done reliably. As a result, the position of the contact point in the housing is controlled accurately, and this also secures the contact pressure.

As described above, when the protrusion is provided on the intermediate part of the contact and the hole for fitting in the protrusion is provided in the bottom wall of the housing, the contact pressure of the contact point can be secured, and the position of the contact point in the housing can be controlled accurately, and this also secures the contact pressure.

The DIP connector of the present invention may be so arranged that the lead is provided on the intermediate part of the contact and the root end of the lead is the protrusion.

With this arrangement, as the root end of the lead, being the protrusion, is inserted in the hole of the bottom wall of the housing, the intermediate part is securely supported by the bottom wall, and in turn, relative movement of the intermediate part and the housing is restrained reliably. Hence the root end of the spring piece does not shake, and the contact point changes its position according to the resilient deformation of the spring piece, and the contact pressure is secured. And, as the protrusion is fitted in the hole of the bottom wall, positioning of the intermediate part and in turn the spring piece in relation to the housing is done reliably. Accordingly, the position of the contact point in the housing is controlled accurately, and this also secures the contact pressure.

As described above, when the lead is provided on the intermediate part of the contact, and the root end of the lead being the protrusion is fitted in the hole in the bottom wall of the housing, the contact pressure of the contact point can be secured, and the position of the contact point in the housing can be controlled accurately, and this in turn secures the contact pressure.

The DIP connector of the present invention may be so arranged that, in place of the intermediate part of the contact being stored in the second concaved part, the intermediate part of the contact is fitted in the second concaved part.

With this arrangement, as fitting the intermediate part in the second concaved part makes the intermediate part be supported securely by the walls constituting the second concaved part, relative movement of the intermediate part and the housing is restrained effectively. Hence the root end of the spring piece does not shake, and the contact point changes its position according to the resilient deformation of the spring piece, the contact pressure can be secured. Moreover, as the intermediate part is fitted in the second concaved part, positioning of the intermediate part and in turn the spring piece in relation to the housing is done reliably. Accordingly, the position of the contact point in the housing is controlled accurately, and this also secures the contact pressure.

As described above, when the intermediate part of the contact is fitted in the second concaved part, the contact pressure of the contact point can be secured, and in turn, the position of the contact point in the housing can be controlled accurately, and this also secures the contact pressure.

The DIP connector of the present invention may be so arranged that the bent part is provided with a contact point for contacting the contact of the counterpart member at a position substantially opposing to the contact point of the spring piece.

With this arrangement, contacting with the contact of the counterpart member is made at two contact points, and the reliability of electrical connection is enhanced.

As described above, when the bent part is provided with a contact point for contacting the contact of the counterpart member at a position substantially opposing to the contact point of the spring piece, contacting with the contact of the counterpart member is made at two contact points, and the reliability of the electrical connection can be enhanced.

The DIP connector of the present invention may be so arranged that the housing is provided with a locking means for reinforcing the strength of connecting with the counterpart member.

When such a locking means is provided, even if the counterpart member is withdrawn from the DIP connector inadvertently without unlocking the locking means, the force of withdrawing the counterpart member will be transmitted reliably to the contact via the bent part and the supporting wall mutually opposing to each other, and then transmitted to the recipient member via the lead, separation of the housing and the contact will be prevented.

As described above, when the housing is provided with the locking means for reinforcing the strength of connecting with the counterpart member, even if the counterpart member is withdrawn from the DIP connector inadvertently without unlocking the locking means, separation of the housing and the contact can be prevented.

DETAILED DESCRIPTION OF THE INVENTION

Figure 1:
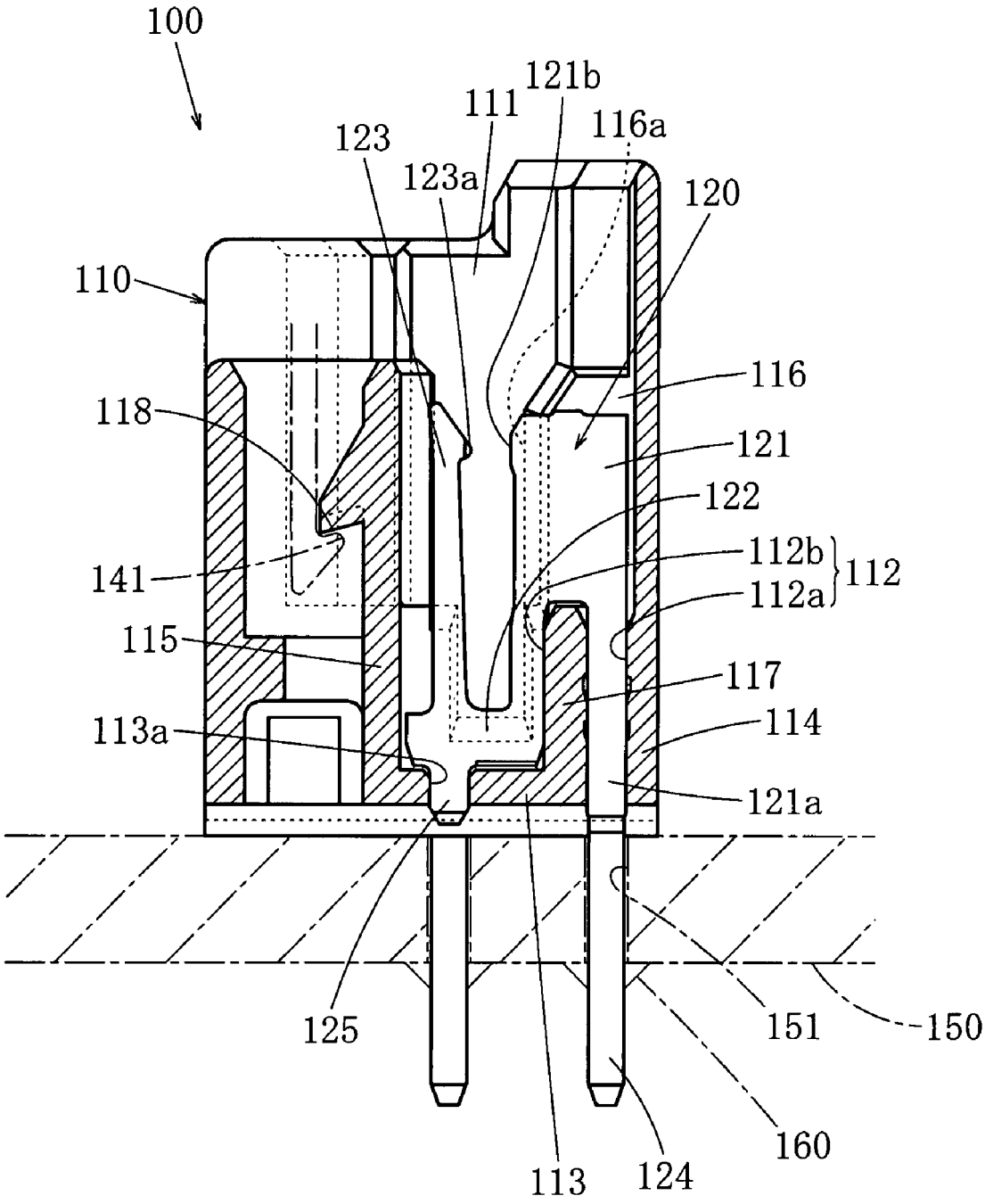
FIG. 1 is a sectional view along a line I-I of FIG. 4. A recipient member and soldered parts, and a locking means of a counterpart member are illustrated with imaginary lines.

In the following, some embodiments of the present invention will be described. FIG. 1 through FIG. 7 illustrate the DIP connector 100 of the first embodiment. This DIP connector 100 is to be mounted on a recipient member 150 having through holes, such as a board, for example, a printed circuit board. A counterpart member such as a plug connector (not illustrated except its locking means) is inserted into the DIP connector 100, and the counterpart member is withdrawn from the DIP connector 100. In the following, a depth direction, a height direction and a width direction all being perpendicular to each other are defined, and description will be given on the basis of them. With reference to FIG. 1, the left-right direction of the diagram is the width direction, the top-bottom direction of the diagram is the height direction, and the direction perpendicular to the paper plane of the diagram is the depth direction.

This DIP connector 100 comprises a housing 110 being made of an insulating material and a contact being made of an electrically conductive material and provided on the housing 110. This contact is a press contact that is made by punching it out of a plate with blanking dies and forming, however, the contact is not limited to it. The contact is of two kinds, namely, a first contact 120 and a second contact 130, and contacts of these two kinds are arranged alternately along the depth direction. However, the number, arrangement, etc. of the contacts in the DIP connector of the present invention are not limited by this embodiment. It is sufficient for the DIP connector of the present invention that it is provided with at least one contact, and all the contacts of the DIP connector may be unified in the same construction, or contacts of three or more kinds may be used in combination in the DIP connector. In that case, conventional well-known contacts may be present as some of the contacts.

The housing 110 is provided with a receiving chamber 111, which is concaved from one end in the height direction and into which a counterpart member is to be fitted. The housing 110 is also provided with storing concaved parts 112 to the number of the contacts, said storing concaved parts 112 being concaved in the height direction from the receiving chamber 111. The first contacts 120 and the second contacts 130 are fitted in the storing concaved parts 112. The first contacts 120 and the second contacts 130 are fitted into the housing 110 through an opening of the receiving chamber 111 and fitted in the storing concaved parts 112.

The storing concaved part 112 is bounded and formed by a bottom wall 113 being located on a side, in the height direction, opposite to the opening of the receiving chamber 111 of the housing 110, a first wall 114 provided on one side in the width direction, a second wall 115 provided on the other side in the width direction, and third walls 116 provided on both sides in the depth direction. As the inner face of the bottom wall 113 is substantially perpendicular to the height direction, the bottom wall 113 substantially faces in the height direction. As the inner faces of the first wall 114 and the second wall 115 are substantially perpendicular to the width direction, the first wall 114 and the second wall 115 substantially face in the width direction. The first wall 114 and the second wall 115 substantially oppose to each other in the width direction. As the inner faces of the third walls 116 are substantially perpendicular to the depth direction, the third walls 116 substantially face in the depth direction. The third walls 116 on both sides substantially oppose to each other in the depth direction. The third wall 116 is provided with a substantially U-shaped concave 116*a* extending from the edge on the opening side of the receiving chamber 111 in the height direction so as to avoid interference between the third wall 116 and a counterpart member when the counterpart member is to be received. Here, the inner face means a face facing to the storing concaved part 112.

The housing 110 is provided with a support wall 117 rising from said bottom wall 113 in the height direction. As both faces of the support wall 117 are substantially perpendicular to the width direction, the support wall substantially faces in the width direction. This support wall 117 divides said storing concaved part 112 into a first concaved part 112*a* on the side of the first wall 114 and a second concaved part 112*b* on the side of the second wall 115.

Figure 2:
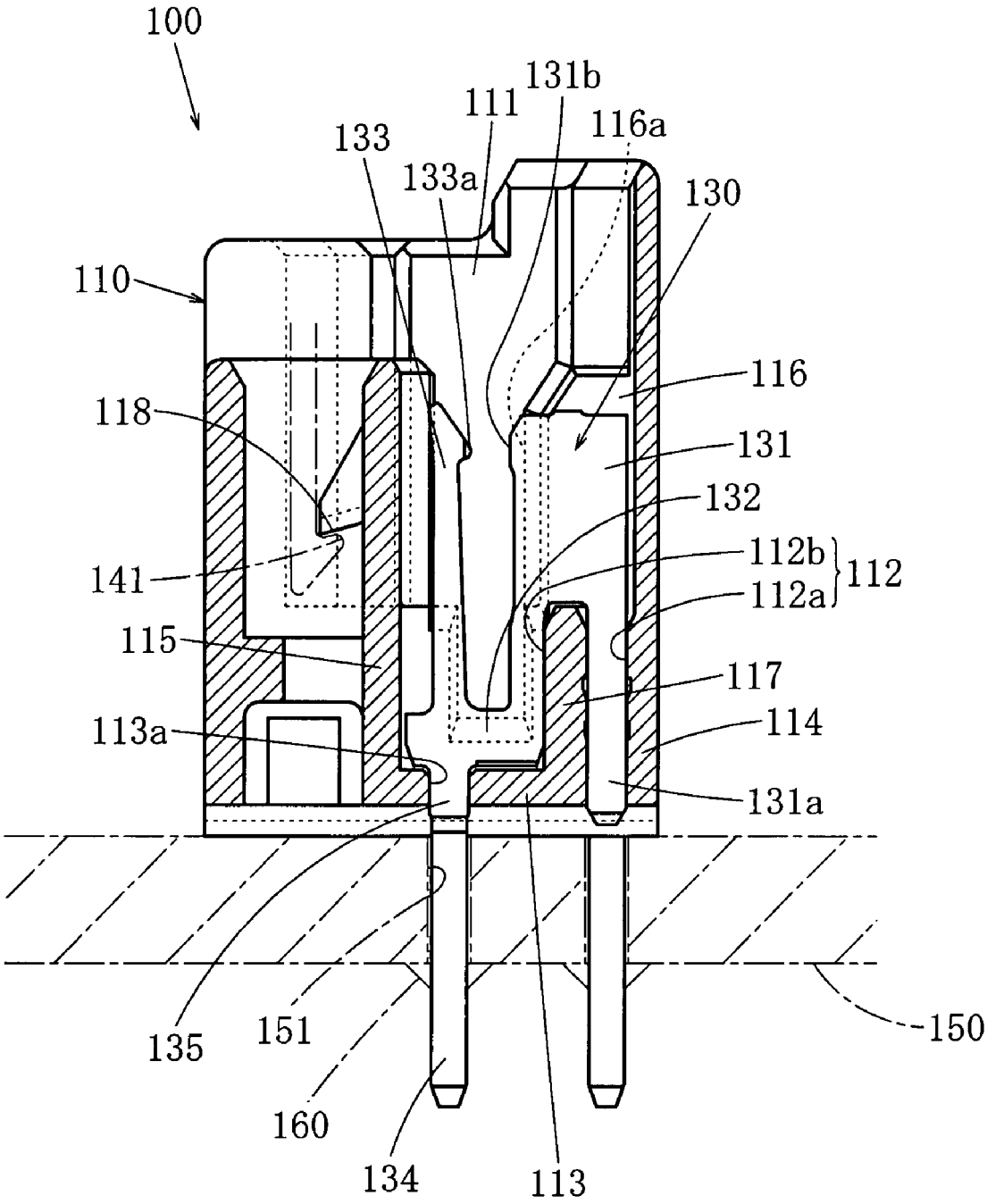
FIG. 2 is a sectional view along a line II-II of FIG. 4. The recipient member and soldered parts, and the locking means of the counterpart member are illustrated with imaginary lines.
Figure 3:
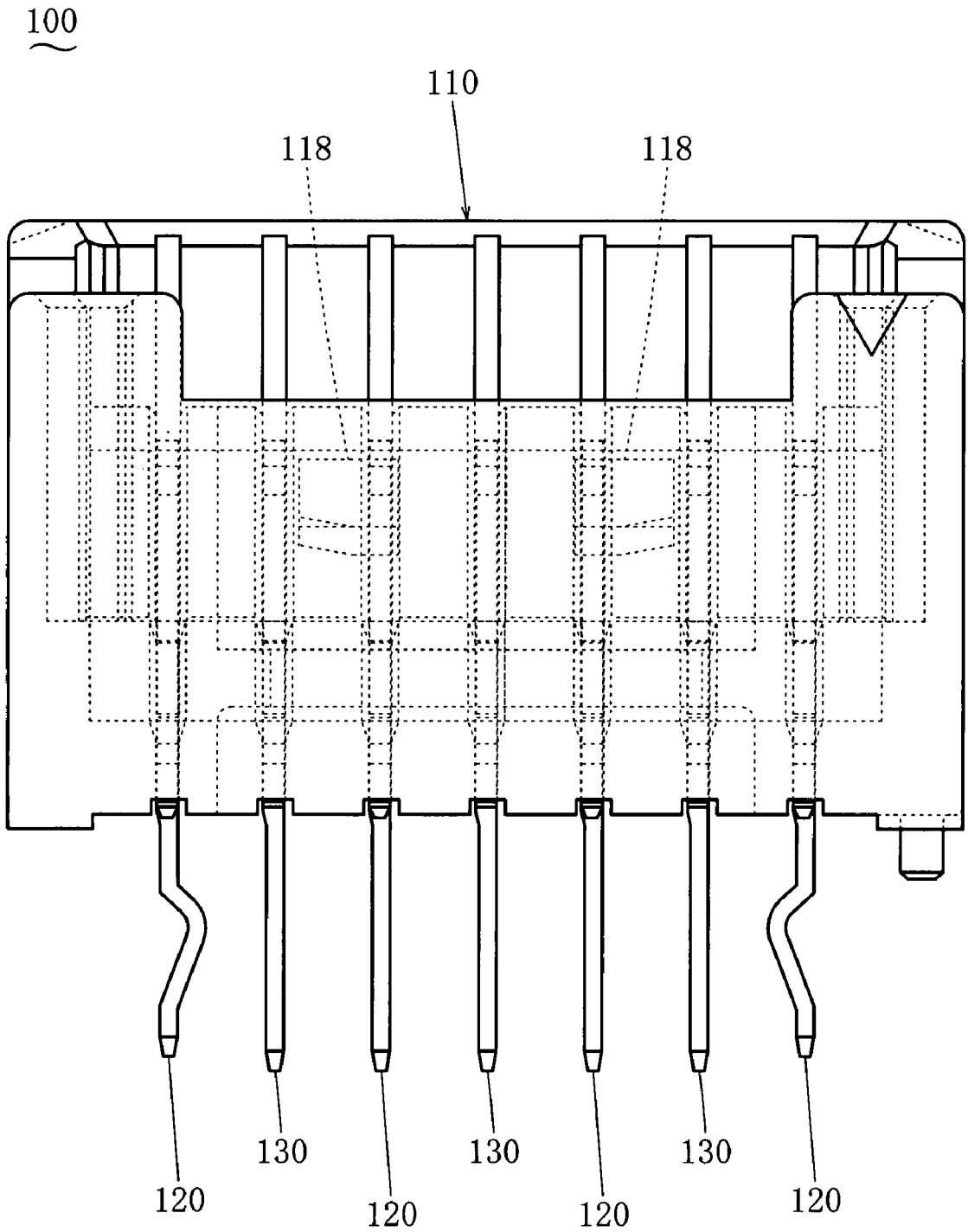
FIG. 3 is a front view of the DIP connector of the first embodiment of the present invention.
Figure 4:
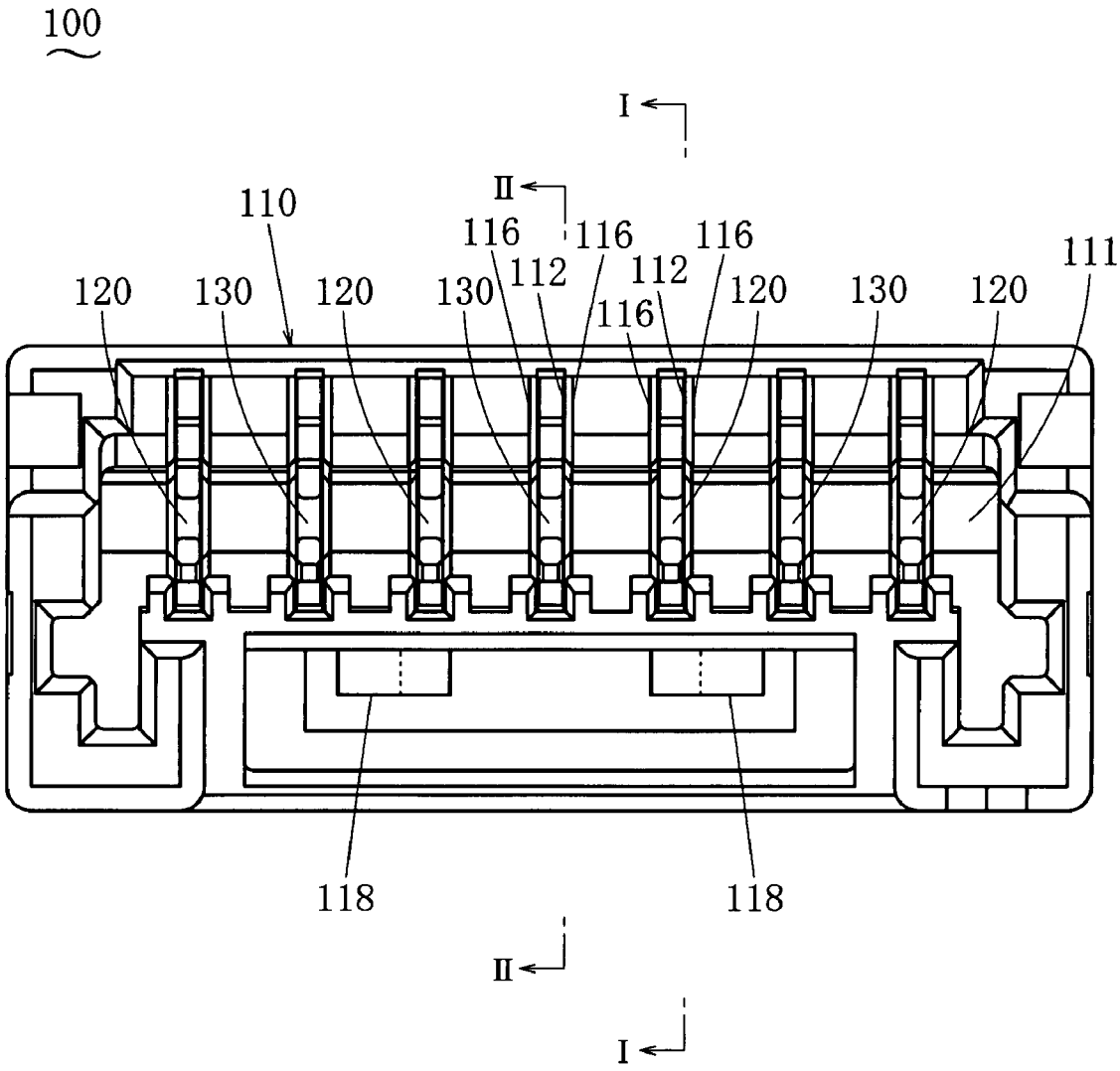
FIG. 4 is a plan view of the DIP connector of the first embodiment of the present invention.
Figure 5:
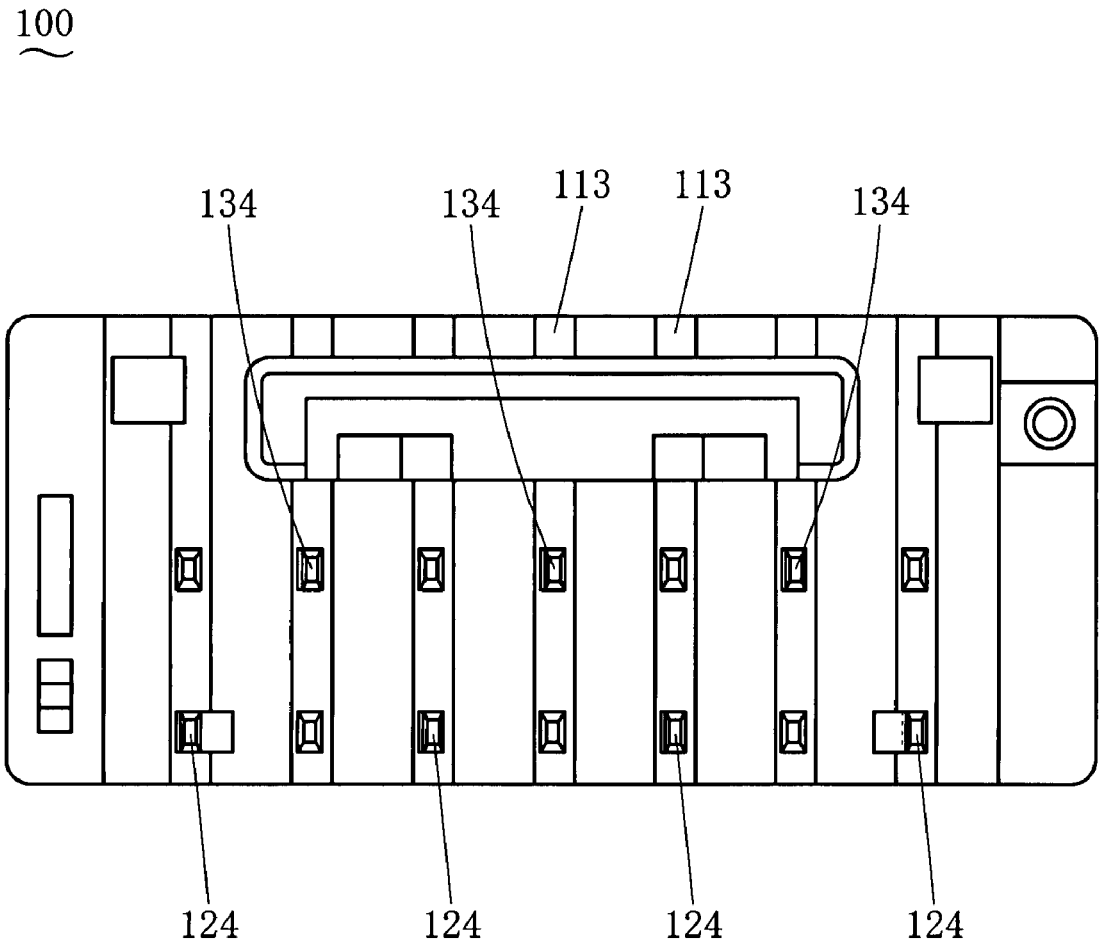
FIG. 5 is a bottom view of the DIP connector of the first embodiment of the present invention.
Figure 6:
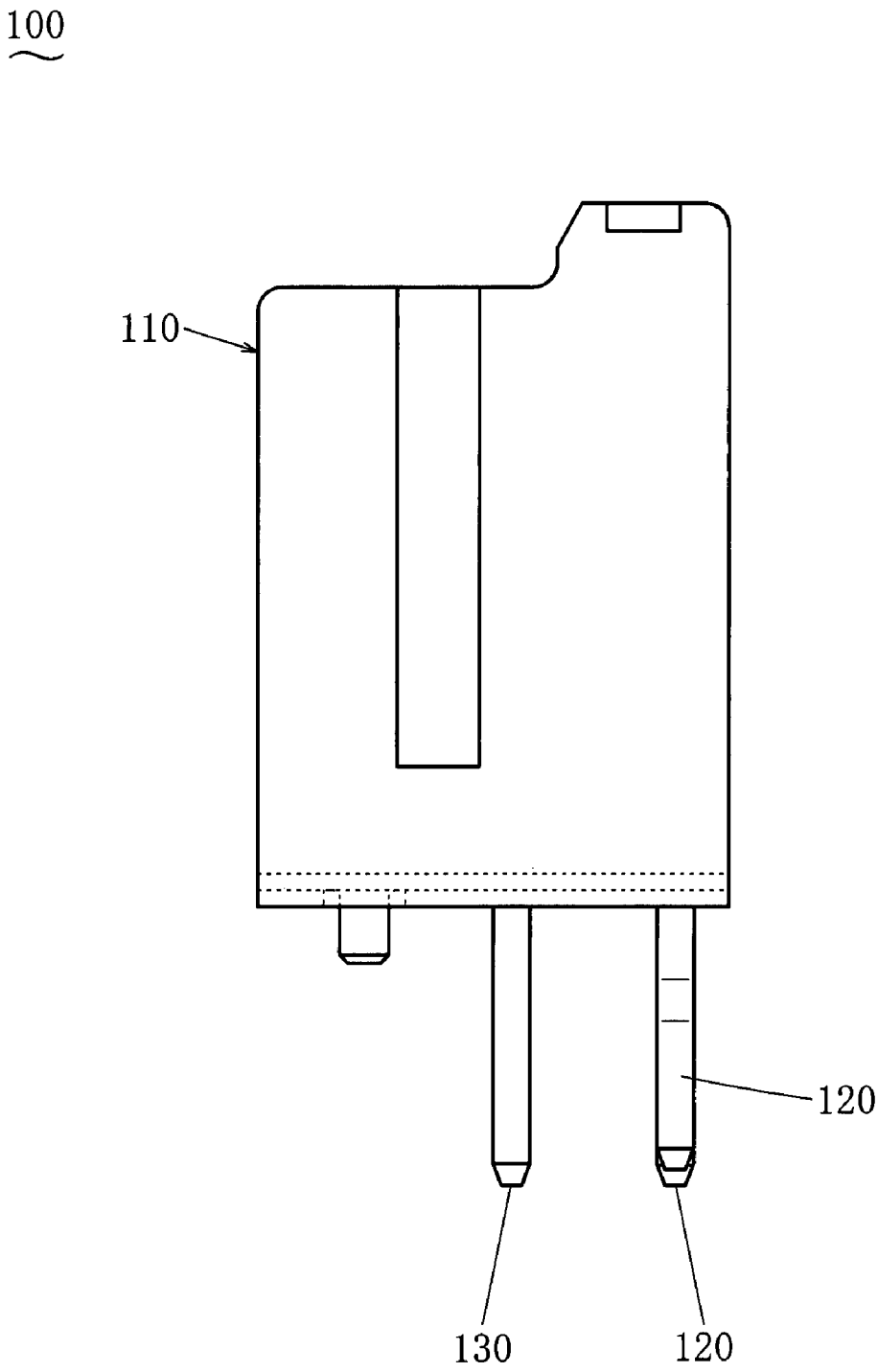
FIG. 6 is a side view of the DIP connector of the first embodiment of the present invention.
Figure 7:
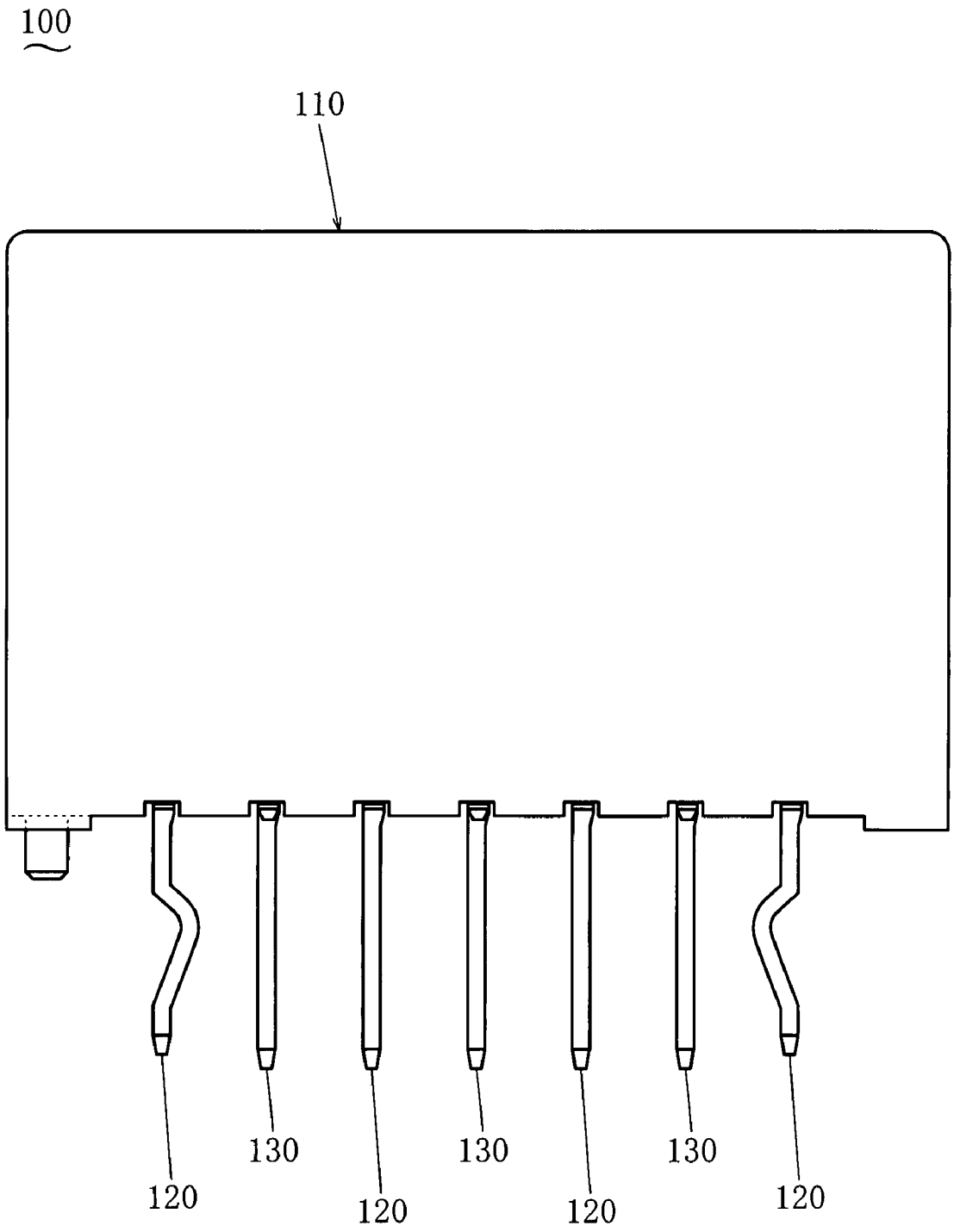
FIG. 7 is a rear view of the DIP connector of the first embodiment of the present invention.

As illustrated in FIG. 1, the first contact 120 comprises a bent part 121, an intermediate part 122 extending in the width direction from the bent part 121, a spring piece 123 rising from the intermediate part 122 in the height direction, and a lead 124 provided on the bent part 121. On the other hand, as illustrated in FIG. 2, the second contact 130 comprises a bent part 131, an intermediate part 132 extending from the bent part 131 in the width direction, a spring piece 133 rising from the intermediate part 132 in the height direction, and a lead 134 provided on the intermediate part 132.

The bent parts 121, 131 are formed into substantially inverted-U forms seen in the depth direction, and straddle on said support wall 117. One end in the width direction of the bent part 121 and one end in the width direction of the bent part 131 extend as the fitted-in parts 121*a*, 131*a* along the height direction, in a direction away from the opening of the receiving chamber 111, and these fitted-in parts 121*a*, 131*a* fit in the first concaved parts 112*a*. The mode of this fitting-in is called press fitting, and pressures work between the fitted-in parts 121*a*, 131*a*, and the first wall 114 and the support wall 117 constituting the first concaved parts 112*a*. In contrast to this, there is hardly or no pressure working between the fitted-in parts 121*a*, 131*a* and the third walls 116 constituting the first concaved parts 112*a*, and the third walls 116 exhibit guiding functions at the time of fitting-in of the fitted-in parts 121*a*, 131*a*. In this case, conversely, it may be so arranged that there is hardly any pressures or no pressure working between the fitted-in parts 121*a*, 131*a*, and the first wall 114 and the support wall 117, and there are pressures working between the fitted-in parts 121*a*, 131*a* and the third walls 116. Or it may be so arranged that there are pressures working between the fitted-in parts 121*a*, 131*a*, and the first wall 114, the support wall 117 and the third walls 116.

The intermediate parts 122, 132 are provided, of the both ends in the width direction of the bent parts 121, 131, on the side opposite to the end on which the fitted-in parts 121*a*, 131*a* are provided, and extend from that end along the width direction, in a direction away from the fitted-in parts 121*a*, 131*a*. The intermediate parts 122, 132 are stored in the second concaved parts 112*b*. In other words, there is hardly any pressure or no pressure working between the intermediate parts 122, 132, and the bottom wall 113, the support wall 117, the second wall 115 and the third walls 116 constituting the second concaved parts 112*b*, and these walls exhibit guiding functions at the time of fitting-in of the intermediate parts 122, 132.

The spring pieces 123, 133 rise from the intermediate parts 122, 132 along the height direction, in a direction toward the opening of the receiving chamber 111. The spring pieces 123, 133 are provided, in the neighborhoods of the top ends thereof, at positions facing the bent parts 121, 131, with contact points 123*a*, 133*a* that contact the contacts of the counterpart member.

As illustrated in FIG. 1, in the case of the first contact 120, the lead 124 is provided on the fitted-in part 121*a* of the bent part 121, and penetrates the bottom wall 113 of the housing 110 and extends along the height direction, in a direction away from the opening of the receiving chamber 111. On the other hand, as illustrated in FIG. 2, in the case of the second contact 130, the lead 134 is provided on the intermediate part 132, and penetrates the bottom wall 113 of the housing 110 and extends along the height direction, in a direction away from the opening of the receiving chamber 111.

In the first contact 120, a protrusion 125 is provided on the intermediate part 122 to extend along the height direction, in a direction away from the opening of the receiving chamber 111. Moreover, a hole 113*a* into which the protrusion 125 is to be fitted is provided in the bottom wall 113 of the housing 110. The mode of this fitting-in is press fitting, and pressures work between the protrusion 125 and the walls constituting the hole 113*a*.

In the second contact 130, the root end of the lead 134 that is provided on the intermediate part 132 serves as a protrusion 135. And the bottom wall 113 of the housing 110 is provided with a hole 113*a* into which this protrusion 135 is to be fitted. The mode of this fitting-in is press fitting, and pressures work between the protrusion 135 and the walls constituting the hole 113*a*.

The bent parts 121, 131 are provided, at positions substantially opposing to the contact points 123*a*, 133*a* of the spring pieces 123, 133, with contact points 121*b*, 131*b* for contacting the contacts of the counterpart member.

The housing 110 is provided with a locking means 118 that reinforces the strength of connection with the counterpart member. This locking means 118 is constituted by a protrusion protruding in the width direction from a wall face facing in the width direction in the housing 110. The faces on both sides in the height direction of this protrusion are so tilted that they move away from the opening of the receiving chamber 111 as they move away from the wall face. On the other hand, the counterpart member is provided with a locking means 141. This locking means 141 is a cantilevered arm extending in the height direction, and its top end is made to protrude in the width direction to form a hook. Accordingly, when the counterpart member is fitted into the DIP connector 100 and the locking means 141 of the counterpart member enters through the opening of the receiving chamber 111, the locking means 141 of the counterpart member will undergo resilient deformation, the hook part at the top end thereof will move on the face, being closer to the opening, of the locking means 118 of the housing 110 and go beyond that and fit on the face remoter to the opening to complete locking. Unlocking of the lock is made by making the locking means 141 of the counterpart member undergo resilient deformation again to separate the hook part from the locking means 118. The locking means of the DIP connector includes a protrusion protruding from a wall face facing in another direction.

This DIP connector 100 is mounted on a recipient member 150 having through holes 151, such as a board. In other words, mounting is done by inserting the lead 124 of the first contact 120 and the lead 134 of the second contact 130 of the DIP connector 100 in the through holes 151 of the recipient member 150 and soldering them onto the recipient member 150. In FIG. 1, 160 denotes a soldered part. When the counterpart member is fitted in the receiving chamber 111, the contacts of the counterpart member will contact the contact points 123*a*, 121*b* of the first contact 120 and the contact points 133*a*, 131*b* of the second contact 130 of the DIP connector 100 to establish mechanical connection and electrical connection between the DIP connector 100 and the counterpart member. And when the counterpart member is withdrawn from the DIP connector 100, the force of pulling out the counterpart member will work on the housing 110. However, as the bent part 121 of the first contact 120 straddles on the support wall 117, and the lead 124, which is provided on the fitted-in part 121*a* of the bent part 121 is mounted on the recipient member 150, the force of pulling out the counterpart member will be reliably transmitted to the first contact 120 via the bent part 121 and the support wall 117 mutually opposing to each other, and then transmitted to the recipient member 150 via the lead 124. On the other hand, as the bent part 131 of the second contact 130 straddles on the support wall 117, and the lead 134, which is provided on the intermediate part 132, is mounted on the recipient member 150, the force of pulling out the counterpart member will be reliably transmitted to the second contact 130 via the bent part 131 and the support wall 117 mutually opposing to each other, and then transmitted to the recipient member 150 via the lead 134. Accordingly, separation between the housing 110 and the first contact 120 or the second contact 130 will be prevented. In this case, it is possible to do without providing reinforcing tabs, and this will prevent increases in costs due to, for example, increase in the number of components and increase in the number of soldered parts of the DIP connector 100.

In both the first contact 120 and the second contact 130, as the spring pieces 123, 133 rise in the height direction not from the bent parts 121, 131 but the intermediate parts 122, 132, the heights of the top ends of the spring pieces 123, 133 are restrained, and reduction in the height of the DIP connector 100 is realized.

When the first contact 120, in which the lead 124 is provided on the fitted-in part 121*a* of the bent part 121, and the second contact 130, in which lead 134 is provided on the intermediate part 132, are arranged alternately along the depth direction, the leads 124, 134 will be arranged in a zigzag form. With this arrangement, even if the DIP connector 100 has a narrow pitch, namely, the interval between neighboring leads in the depth direction is small, the space between the leads will be widened in effect.

The present invention includes an embodiment of the DIP connector wherein no protrusion is provided on the intermediate part of the contact. However, in the case of the DIP connector 100 of said first embodiment, the intermediate part 122 of the first contact 120 is provided with a protrusion 125 protruding in the height direction, and the bottom wall 113 of the housing 110 is provided with a hole 113*a* into which the protrusion 125 is fitted. And the intermediate part 132 of the second contact 130 is provided with a protrusion 135 protruding in the height direction, and the bottom wall 113 of the housing 110 is provided with a hole 113*a* into which the protrusion 135 is fitted. With this arrangement, as the intermediate parts 122, 132 are securely supported by the bottom wall 113 because the protrusions 125, 135 are fitted in the holes 113*a* of the bottom wall 113, relative movement of the intermediate parts 122, 132 and the housing 110 is reliably restrained. Thus, as the root ends of the spring pieces 123, 133 do not shake, and the contact points 123*a*, 133*a* change their positions according to the resilient deformation of the spring pieces 123, 133, the contact pressures can be secured. Moreover, as the protrusions 125, 135 are fitted in the holes 113*a* of the bottom wall 113, positioning of the intermediate parts 122, 132 and in turn the spring pieces 123, 133 in relation to the housing 110 is done reliably. As a result, the positions of the contact points 123*a*, 133*a* in the housing 110 are controlled accurately, and this also secures the contact pressures.

In the present invention, as is the case with the first contact 120, the lead may be provided on the fitted-in part of the bent part. And when the lead is provided on the intermediate part of the contact, the lead may be made to merely penetrate a hole in the bottom wall of the housing in such a way that there is hardly any or no pressure working between the lead and the walls constituting the hole. However, in the case of the second contact 130 of the DIP connector 100 of said first embodiment, the lead 134 is provided on the intermediate part 132 of the second contact 130 and the root end of the lead 134 is a protrusion. 135 that fits in the hole 113*a*. With this arrangement, as the root end of the lead 134, being the protrusion 135, is fitted in the hole 113*a* of the bottom wall 113 of the housing 110, the intermediate part 132 is securely supported by the bottom wall 113, and in turn, relative movement of the intermediate part 132 and the housing 110 is restrained reliably. Hence the root end of the spring piece 133 does not shake, and the contact point 133*a* changes its position according to the resilient deformation of the spring piece 133, and the contact pressure is secured. And, as the protrusion 135 is fitted in the hole 113*a* of the bottom wall 113, positioning of the intermediate part 132 and in turn the spring piece 133 in relation to the housing 110 is done reliably. Accordingly, the position of the contact point 133*a* in the housing 110 is controlled accurately, and this also secures the contact pressure.

The present invention includes an embodiment of the DIP connector wherein only the spring piece is provided with a contact point. However, in the case of the DIP connector 100 of said first embodiment, the bent parts 121, 131 are provided with contact points 121*b*, 131*b* for contacting contacts of a counterpart member at positions substantially opposing to the contact points 123*a*, 133*a* of the spring pieces 123, 133. With this arrangement, contacting with the contacts of the counterpart member is made at two contact points 123*a*, 121*b* and two contact points 133*a*, 131*b*, and the reliability of electrical connection is enhanced.

The present invention includes an embodiment of the DIP connector wherein the housing is not provided with a locking means. However, in the case of the DIP connector 100 of said first embodiment, the housing 110 is provided with a locking means 118 for reinforcing the strength of connecting with the counterpart member. When such locking means 118 is provided and even if the counterpart member is withdrawn from the DIP connector 100 inadvertently without unlocking the locking means 118 from the locking means 141 of the counterpart member, the force of withdrawing the counterpart member will be transmitted reliably to the first contact 120 and the second contact 130 via the bent parts 121, 131 and the support wall 117 opposing to each other, and then transmitted to the recipient member via the leads 124, 134, hence separation of the housing 110 and the first contact 120 and the second contact 130 will be prevented.

Figure 8:
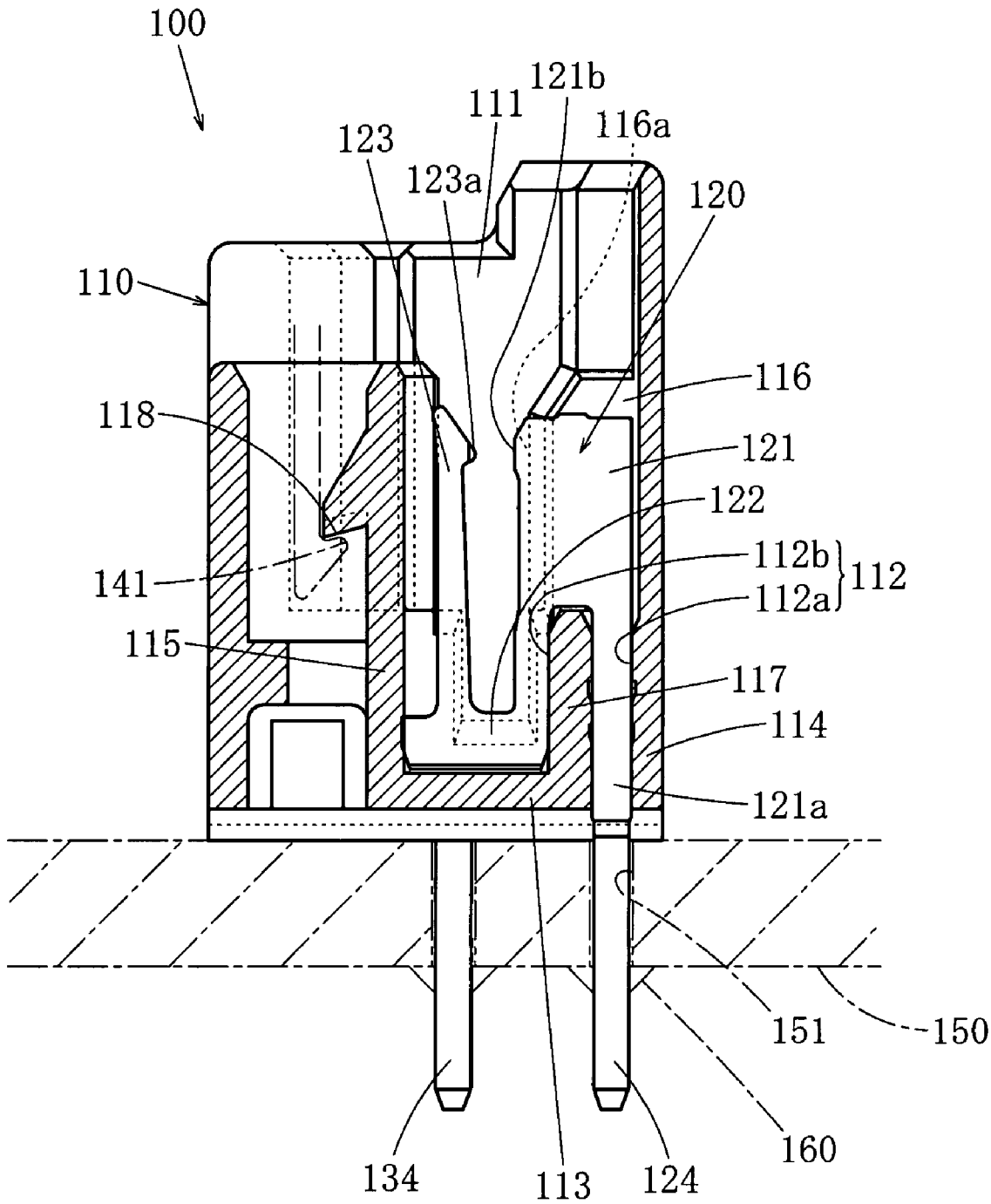
FIG. 8 is a diagram of a DIP connector of the second embodiment of the present invention and corresponds to FIG. 1. A recipient member and soldered parts, and locking means of a counterpart member are illustrated with imaginary lines.

FIG. 8 illustrates the second embodiment of the DIP connector according to the present invention. This DIP connector 100 comprises a housing 110, a first contact 120 and a second contact 130. In the DIP connector 100 of the second embodiment, the construction of the first contact 120, and the construction of some portions of the housing 110 corresponding to the first contact 120 differ from that of the DIP connector 100 of the first embodiment, but the rest of the construction is similar to the construction of the DIP connector 100 of the first embodiment. In the DIP connector 100 of the first embodiment, the intermediate part 122 of the first contact 120 is stored in the second concaved part 112*b*, but in the DIP connector 100 of the second embodiment, however, instead of that, the intermediate part 122 of the first contact 120 is fitted in the second concaved part 112*b*. This mode of fitting-in is called press fitting, and pressures work between the intermediate part 122, and the support wall 117 and the second wall 115 constituting the second concaved part 112*b*. In contrast to this, there is hardly any or no pressure working between the intermediate part 122, and the third walls 116 constituting the second concaved wall 112*b*, and the third walls 116 exhibit guiding functions at the time of fitting-in of the intermediate part 122. In this case, conversely, it may be so arranged that there is hardly any or no pressure working between the intermediate part 122, and the support wall 117 and the second wall 115, and there are pressures working between the intermediate part 122 and the third walls 116. And it may be so arranged that there are pressures working between the intermediate part 122, and the support wall 117, the second wall 115 and the third walls 116. Now, in the first contact 120 of the first embodiment, the intermediate part 122 is provided with the protrusion 125 protruding in the height direction, and the bottom wall 113 of the housing 110 is provided with the hole 113*a* into which this protrusion 125 is fitted, but in the first contact 120 of the second embodiment, no such protrusion is provided, and the bottom wall 113 of the housing 110 is not provided with such a hole. However, in the first contact 100 and the housing 110 of the second embodiment, such protrusion and hole may be provided.

In the DIP connector 100 of the second embodiment, as is the case with the DIP connector 100 of the first embodiment, the intermediate part 132 of the second contact 130 is stored in the second concaved part 112*b*, but instead of this, the intermediate part 132 of the second contact 130 may be fitted in the second concaved part 112*b*. The mode of this fitting-in is called press fitting and is similar to one described in relation to the first contact 120. In this case, it may be so arranged that the lead 134 merely penetrates the hole 113*a* of the bottom wall 113 of the housing 110 and there is hardly any or no pressure working between the lead and the walls constituting the hole, or that as is the case with the second contact 130 of the DIP connector 100 of the first embodiment, the root end of the lead 134 is a protrusion 135 and is fitted in the hole 113*a* of the bottom wall 113 of the housing 110.

In the DIP connector 100 of said second embodiment, as the intermediate part 122 of the first contact 120 is fitted in the second concaved part 112*b*, the intermediate part 122 is securely supported by walls constituting the second concaved part 112*b*, and in turn, relative movement between the intermediate part 122 and the housing 110 is reliably restrained. Accordingly, as the root end of the spring piece 123 does not shake, and the contact point 123*a* changes its position according to the resilient deformation of the spring piece 123, the contact pressure can be secured. Furthermore, as the intermediate part 122 is fitted in the second concaved part 112*b*, positioning of the intermediate part 122 and in turn the spring piece 123 in relation to the housing 110 is made reliably. Accordingly, the position of the contact point 123*a* in the housing 110 is controlled accurately, and this also secures the contact pressure. Other actions and effects are similar to the actions and effects obtained by the DIP connector 100 of the first embodiment. Moreover, as is the case with the first embodiment, it may be so arranged that the bent parts 121, 131 are not provided with the contact points 121*b*, 131*b* and only the spring pieces 123, 133 are provided with the contact points 123*a*, 133*a*, and that the housing 110 is not provided with the locking means 118.

The present invention includes embodiments wherein some features of the embodiments described above are combined. And the embodiments described above merely indicate some examples of the DIP connector according to the present invention. Accordingly, the DIP connector of the present embodiment must not be construed limitedly by the description of these embodiments.

The disclosure of Japanese Patent Application No. 2006-110332 filed on Apr. 12, 2006 including specification, drawings and claims is incorporated herein by reference in its entirety.

The invention claimed is:

1. A DIP connector comprising a housing being provided with a receiving chamber being concaved from one end in a height direction thereof and into which a counterpart member being to be fitted, and a contact being fitted in a storing concaved part being provided in the housing and concaved from the receiving chamber; and said storing concaved part being bounded and formed by a bottom wall being located on a side opposite, in the height direction, to an opening of the receiving chamber in the housing, a first wall being provided on one side in a width direction being perpendicular to the height direction, a second wall being provided on the other side in the width direction, and third walls being provided on both sides in a depth direction being perpendicular to both the height direction and the width direction;

said housing being provided with a support wall rising from said bottom wall in the height direction and dividing said storing concaved part into a first concaved part on the first wall side and a second concaved part on the second wall side;

and said contact comprising a bent part straddling on said support wall and one end, in the width direction, of said bent part being to be fitted, as a fitted-in part, in the first concaved part, an intermediate part extending in the width direction from the other end in the width direction of the bent part and being to be stored in the second concaved part, a spring piece rising from the intermediate part in the height direction and being provided with a contact point for contacting a contact of the counterpart member at a position being near the top end thereof and facing the bent part, and a lead being provided on the fitted-in part of the bent part or on the intermediate part, penetrating the bottom wall of the housing and extending in the height direction.

2. The DIP connector according to claim 1, wherein the bent part is provided with a contact point for contacting the contact of the counterpart member at a position substantially opposing to the contact point of the spring piece.

3. The DIP connector according to claim 1, wherein the housing is provided with a locking means for reinforcing the strength of connecting with the counterpart member.

4. The DIP connector according to claim 1, wherein the intermediate part of the contact is provided with a protrusion protruding in the height direction, and the bottom wall of the housing is provided with a hole in which the protrusion is fitted.

5. The DIP connector according to claim 2, wherein the lead is provided on the intermediate part of the contact, and the root end of the lead is the protrusion.

6. The DIP connector according to claim 1, wherein the intermediate part is fitted in the second concaved part.

7. The DIP connector according to claim 6, wherein the bent part is provided with a contact point for contacting the contact of the counterpart member at a position substantially opposing to the contact point of the spring piece.

8. The DIP connector according to claim 6, wherein the housing is provided with a locking means for reinforcing the strength of connecting with the counterpart member.

9. The DIP connector according to claim 6, wherein the intermediate part of the contact is provided with a protrusion protruding in the height direction, and the bottom wall of the housing is provided with a hole in which the protrusion is fitted.

10. The DIP connector according to claim 9, wherein the lead is provided on the intermediate part of the contact, and the root end of the lead is the protrusion.

* * * * *